US006533222B1

(12) United States Patent
Brooks

(10) Patent No.: US 6,533,222 B1
(45) Date of Patent: Mar. 18, 2003

(54) RAILWAY VEHICLE SAFETY SHUNT SYSTEM

(76) Inventor: Gaetano D. Brooks, 1101 Floyd Ave., Waldorf, MD (US) 20602

( * ) Notice: Subject to any disclaimer, the term of this patent is extended or adjusted under 35 U.S.C. 154(b) by 0 days.

(21) Appl. No.: 10/046,388

(22) Filed: Jan. 16, 2002

(51) Int. Cl.[7] ..... B61L 21/00

(52) U.S. Cl. ..... 246/28 R; 246/25; 246/73

(58) Field of Search ..... 246/28 R, 65, 246/73, 122 R, 124, 122 A, 192 A, 255, 254; 191/45 R, 63; 105/72.2, 215.1, 215.2

(56) References Cited

U.S. PATENT DOCUMENTS

| | | | | |
|---|---|---|---|---|
| 1,945,283 A | * | 1/1934 | Loomis | 152/151 |
| 2,211,181 A | * | 8/1940 | Thompson | 246/34 R |
| 2,853,957 A | * | 9/1958 | Dean et al. | 104/279 |
| 3,387,064 A | * | 6/1968 | Joy et al. | 246/1 R |
| 3,879,004 A | | 4/1975 | Andreasen | |
| 3,887,152 A | | 6/1975 | Eblovi | |
| 4,068,598 A | | 1/1978 | Bardet | |
| 4,387,870 A | | 6/1983 | Matty et al. | |
| 4,420,133 A | | 12/1983 | Dietrich | |
| 4,469,298 A | | 9/1984 | Uebel | |
| 4,471,929 A | | 9/1984 | Rhoton et al. | |
| 4,488,494 A | | 12/1984 | Powell, Sr. | |
| 4,583,465 A | | 4/1986 | Powell, Sr. | |
| 4,979,392 A | | 12/1990 | Guinon | |
| 5,054,722 A | | 10/1991 | Bartel et al. | |
| 5,170,970 A | | 12/1992 | Ballinger | |
| 5,242,136 A | | 9/1993 | Cribbens et al. | |
| 5,330,134 A | | 7/1994 | Ehrlich | |
| 5,464,176 A | | 11/1995 | Kruse | |
| 5,673,774 A | | 10/1997 | Trapp et al. | |
| 5,746,399 A | | 5/1998 | Ehrlich et al. | |

OTHER PUBLICATIONS

Inventor's photographs of a competitor's prior art shunt system, as observed in public use by the inventor and his attorney (35 U.S.C. § 102 (b)). (No date).

* cited by examiner

*Primary Examiner*—Mark T. Le
(74) *Attorney, Agent, or Firm*—Lawrence E. Laubscher, Sr.

(57) ABSTRACT

A railway vehicle safety shunt system includes a pair of axle-mounted rail wheels having outer circumferential surfaces that engage the upper surfaces of the rails, respectively, radially outwardly flange portions that engage the lateral portions of the rails, respectively, and adjacent end surfaces that are respectively engaged by a pair of spring-biased wire brushes arranged parallel with the axis of rotation of the associated rail wheel. The brushes are electrically connected by a shunt conductor, thereby to present an indication of the location of the railway vehicle at a remote vehicle position monitoring and dispatching station.

11 Claims, 5 Drawing Sheets

RAILWAY VEHICLE SAFETY SHUNT SYSTEM

BACKGROUND OF THE INVENTION

1. Field of the Invention

A railway vehicle safety shunt system includes a pair of annular axle-mounted rail wheels having outer circumferential surfaces that engage the upper surfaces of the associated rails, respectively, radially outwardly directed flange portions that engage the lateral surfaces of the rails, and central hub portions having end surfaces normal to the axis of rotation of each rail wheel. A pair of collinearly-arranged axially spaced wire brushes are supported between, and parallel with the axes of rotation of, the associated rail wheels, said brushes being spring-biased axially apart into frictional electrical contact with the adjacent hub portion of the associated rail wheel. The brushes are electrically connected together by a shunt conductor, thereby to present an indication of the location of the vehicle at a remotely located vehicle position monitoring and dispatching station.

2. Brief Description of the Prior Art

As shown by the U.S. patents to Bartel, et al., U.S. Pat. No. 5,054,722 and Kruse U.S. Pat. No. 5,464,176, it is well known in the patented prior art to provide shunting devices for indicating the position of a maintenance or inspection railway vehicle on railroad tracks through which electrical monitoring signals are transmitted from a remotely located vehicle position monitoring and dispatching station. In the Bartel et al patent, a wire brush contactor rubs against the rail adjacent the rail guide wheel. Thus, the shunt is automatically engaged when the guide wheels are lowered against the rail. Similarly, in the Kruse patent, the shunting devices are attached to the high rail attachment for making electrical contact with the tracks. Consequently, the brush drags against the track as the maintenance vehicle drives down the track.

Referring to the Powell U.S. Pat. No. 4,488,494, it is also known in the prior art to provide convertible railway inspection and maintenance vehicles having alternately operable resilient wheel and rail wheels for transporting the vehicle along the ground and along the tracks, respectively. Hydraulic motor means are provided for vertically displacing the rail wheels relative to the chassis in order to convert the vehicle for land and rail transport, respectively. Similarly, the Pettibone Corporation of Chicago, Ill. manufactures such a convertible railway vehicle. Applicant is aware that others have proposed to provide a shunt connection between the rail wheels shown in the Powell patent, use being.make of carbon or graphite-containing ceramic contact blocks that frictionally engage the circumferential surfaces of the rail wheels. The contact blocks are electrically connected to define a shunt across the tracks, thereby giving an indication of the instantaneous position of the vehicle. This proposal has the inherent drawback that over time, both the rail wheel circumferential surface and the block contacts tend to chip and become worn through use, thereby affecting the reliability of the shunting operation. Also, mounting of the contact blocks on the vehicle has proven to be rather structurally difficult, making the replacement of the blocks difficult, time-consuming and costly.

The present invention was developed to produce an improved inexpensive and reliable railway shunting system that avoids the above and other drawbacks of the known devices.

SUMMARY OF THE INVENTION

Accordingly, a primary object of the present invention is to provide a railway vehicle safety shunting system including a pair of collinearly arranged axially-spaced conductive electrically connected brush members that are arranged between a pair of rail wheels, together with spring means that bias the brush members axially apart into engaged positions in continuous electrical engagement with the adjacent end surfaces of the rail wheels, respectively, whereby when the rail wheels are in engagement with the transport rails, a shunt is automatically established between the rails to provide an instantaneous indication of the location of the vehicle.

According to a more specific object of the invention, the brush contact members are removably connected with support members that are connected with the vehicle for axial displacement relative to the rail wheels, thereby to permit displacement of the support members axially together against the biasing force of the spring means toward retracted positions at which the brush members may be removed from the support means for replacement or repair. According to a further feature, retaining means may be provided for retaining the support and brush members in their retracted positions relative to the rail wheels.

Another object of the invention is to provide shunt means of the type described above that are suitable for use either with railway vehicles having only rail wheels, or with convertible type vehicles having alternately operable resilient wheels and rail wheels. In the latter case, the wire brush members are mounted for axial displacement on the axle cover member that is displaced simultaneously with the rail wheel axle when the rail wheels are displaced by hydraulic motor means between their operable and inoperable positions relative to the resilient wheels.

According to a further object of the invention, the rail wheels each include a cylindrical circumferential surface adapted to ride on the top of the associated rail, a flange that extends radially outward from the circumferential surface for engagement with the sides of the rails, and a pair of end surfaces, the central portion of each wheel having a hub portion that is supported by the wheel bearing means. In the preferred embodiment, the collinearly arranged conductive brushes are so arranged relative to the rail wheel axle that they are biased outwardly into electrical contact with the end wall surfaces of the hub portions of the rail wheels adjacent the wheel bearing means, respectively. According to another embodiment, the brushes engage the adjacent end faces of the rail wheels at opposite locations spaced radially outwardly from the hub portions of the wheels.

BRIEF DESCRIPTION OF THE DRAWINGS

Other objects and advantages of the invention will become apparent from a study of the following specification, when viewed in the light of the accompanying drawings, in which.

DETAILED DESCRIPTION

Figure 2:
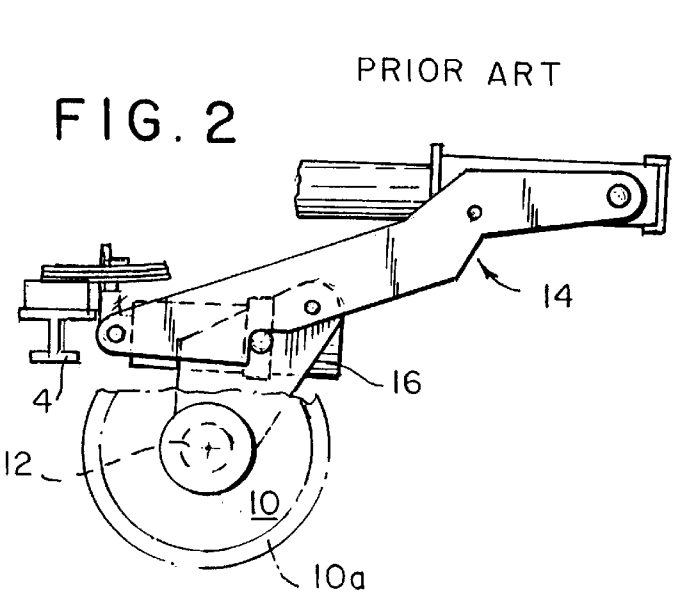
FIGS. 2 and 3 are detailed side views of the rail wheel means of FIG. 1 when in the raised and lowered positions, respectively.
Figure 1:
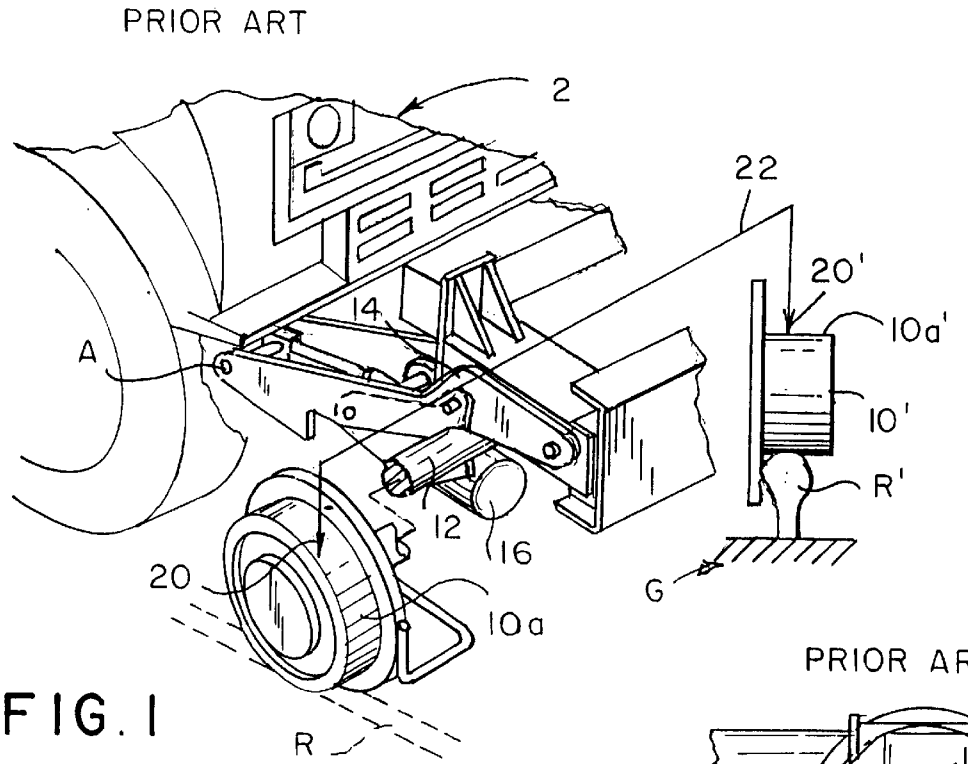
FIG. 1 is a somewhat diagrammatic front perspective view of a railway vehicle shunt system of the prior art.
Figure 3:
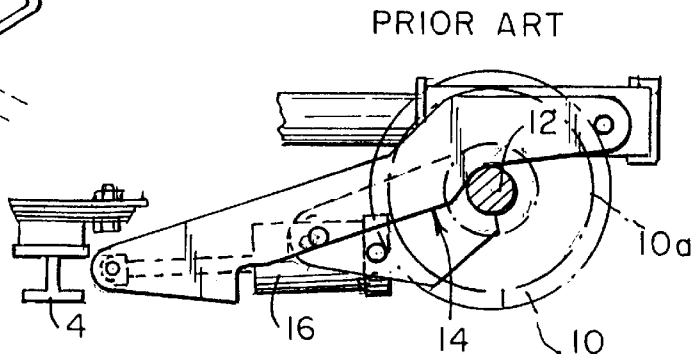

Referring first more particularly to FIGS. 1–3, in the convertible railway inspection and maintenance vehicle illustrated in the Powell U.S. Pat. No. 4,488,494, the railway vehicle 2 has a chassis 4 normally supported by resilient wheels 6 for transport along the ground G adjacent the pair of stationary rails R. A first pair of rail wheels 10 rotatable about an axle 12 are connected with one end of the vehicle chassis by an actuator linkage assembly 14 that is operable by hydraulic motor means 16 to raise and lower the rail wheels between their elevated inoperable and lowered operable positions relative to the rails R.

As shown schematically in FIG. 1, in this prior vehicle, it was proposed to provide conductive graphite or carbon-containing ceramic blocks 20 in electrical engagement with the outer circumferential surfaces 10*a* of the steel rail wheels, these block contacts being connected together by the shunt conductor wire or cable 22. Thus, when the hydraulic motor means 16 is operated to lower the rail wheels 10 into engagement with the rails R, an electrical shorting path is established between the rails via a first steel rail wheel 10, the associated sliding contact 20, shunt conductor cable 22, the other contact 20', and the other steel rail wheel 10'. In this manner, as is known in the art, the instantaneous position of the railway vehicle is displayed on the screen of the remotely located vehicle position monitoring and dispatch station, not shown.

Figure 4:
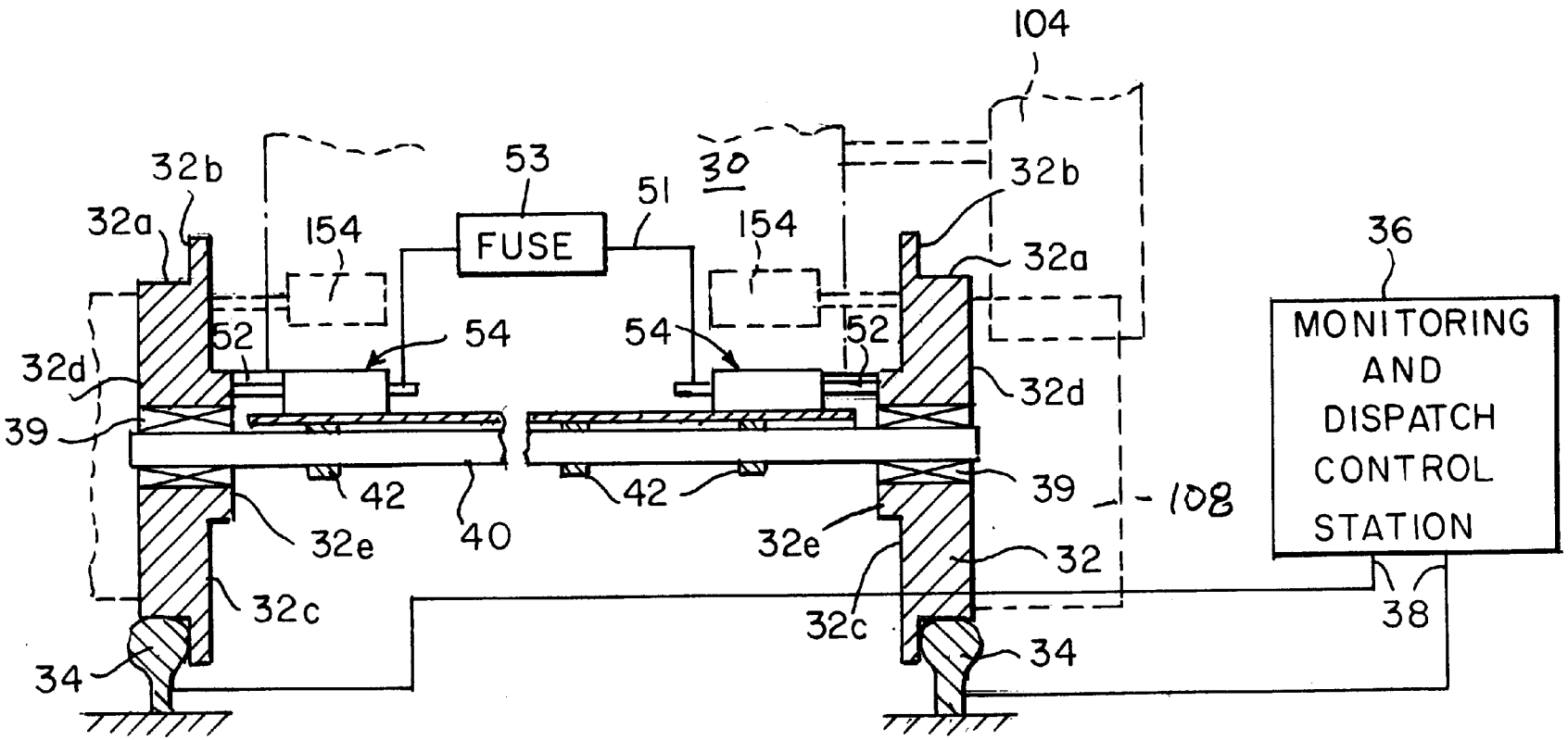
FIG. 4 is a schematic electrical and diagrammatic illustration of the improved shunt system of the present invention.

Referring now to FIG. 4, in accordance with the present invention, the railway vehicle 30 is supported by annular steel rail wheels 32 that engage rails 34 that are connected with a remotely located vehicle position monitoring and dispatch control station 36 by conductors 38. Each rail wheel 32 has a cylindrical circumferential surface 32*a* that rides on the top of the associated rail, and a radial flange portion 32*b* that engages a side surface of the rail. The rail wheel has a pair of inner and outer end surfaces 32*c* and 32*d*. The rail wheels are supported by bearings 38 for rotation about an axle 40. The rail wheels include central hub portions 32*e* adjacent the bearing 38. The axle 40 is connected by supports 42 with the axle cover 44 which in turn is pivotally connected with the vehicle chassis, as will be described below.

In accordance with the present invention, shunt connecting means 50 afford continuous electrical connection between the rail wheels 32, thereby to provide an instantaneous position signal of the vehicle on the tracks to the monitoring and dispatch station 36. The shunt means includes a pair of steel wire brush or twisted rope contacts 52 that are collinearly arranged in spaced relation adjacent the inner end surfaces 32*e* of the rail wheels. Preferably, the contacts 52 are supported by the axle cover 44 and the brush support means 54 at positions adjacent the end surfaces of the central hub portions 32*e* of the rail wheels.

Figure 5:
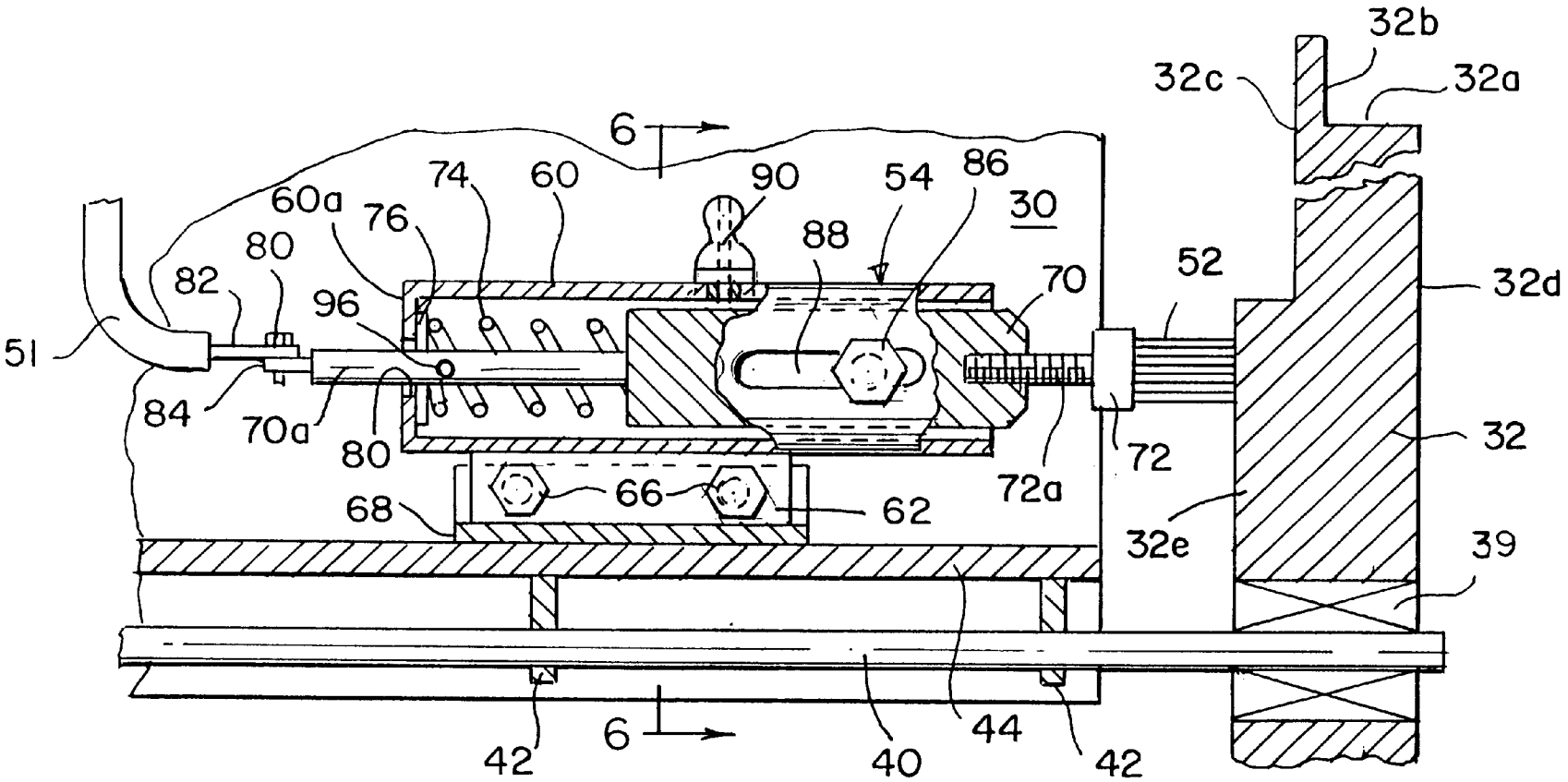
FIG. 5 is a detailed longitudinal sectional view of a brush supporting means of the present invention when in the extended operable condition.
Figure 6:
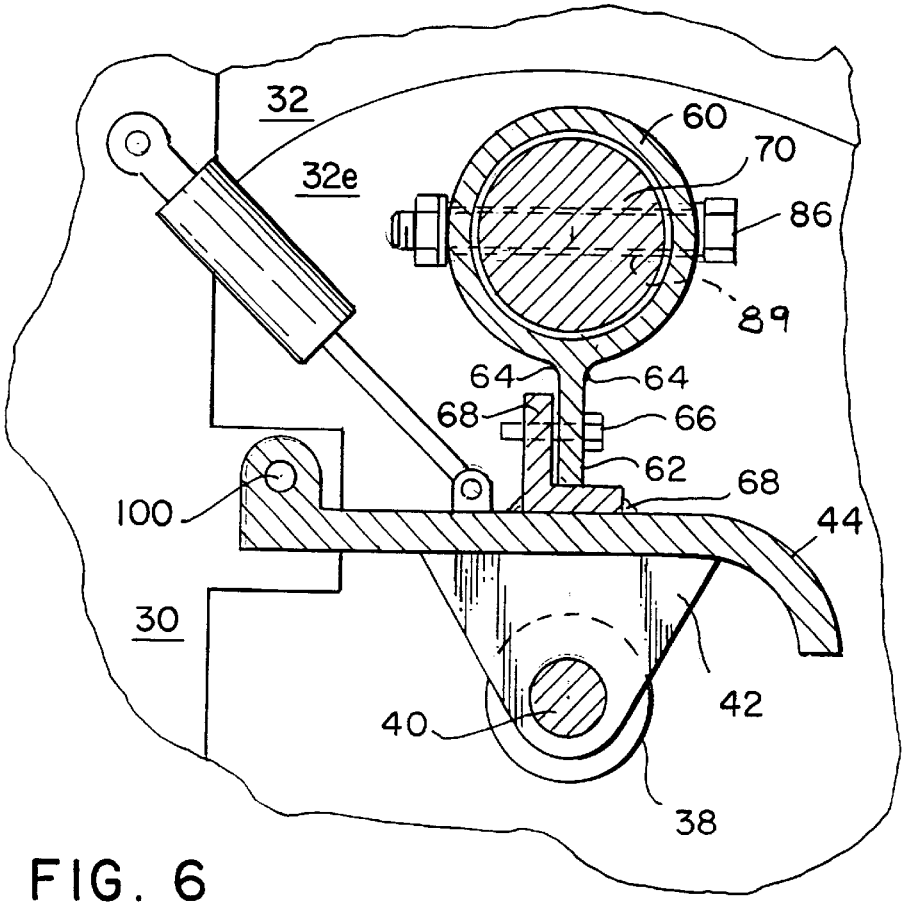
FIG. 6 is a sectional view taken along line 6—6 of FIG. 5.

As shown in greater detail in FIGS. 5 and 6, the support means 54 includes a hollow outer cylindrical steel housing 60 having an open first end adjacent the associated rail wheel 32, the other end of the outer housing being closed by an end wall 60*a*. As best shown in FIG. 6, a vertical support plate 62 is welded longitudinally of the housing by weld seams 64, which support plate is bolted by bolts 66 to the L-shaped bracket 68 that in turn is welded to the axle cover 44 by weld seams 68. Arranged for longitudinal sliding movement concentrically within the open first end of the housing 60 is a cylindrical inner member 70 formed of a conductive metal material such as steel, brass, or the like. At its end adjacent the rail wheel 32, the inner member 70 contains a threaded bore into which is threadably connected the threaded shank portion 72*a* of the brush holder 72 that carries the twisted wire ropes that define the brushes 52. A helical compression spring 74 mounted within the closed end of housing 60 reacts at one end with the support washer 76 and housing end wall 60*a* and at the other end with the adjacent end of the inner brush support member, thereby to bias the inner member outwardly to effect electrical contact between the extremities of the wire brush ropes 52 and the adjacent end face 32*e* of the hub portion of the rail wheel 32.

At its other end, the inner brush support member 70 is provided with a conductive axial extension 70*a* that extends through an opening 80 contained in the housing end wall 60. The shunt connecting means 50 includes a cable 51 connected at each end with the projecting portions 70*a* of the inner members 70 by connector means including bolt 80 and eyelets 82 and 84. The cable 51 may include a shunt fuse 53, if desired, for further safety protection. The inner member 70 is guided for axial displacement within housing 60 by transverse bolt means 86 that extend through diametrically opposed longitudinal slots 88 contained in the housing 60, and a corresponding transverse through bore 89 (FIG. 6) contained in the inner member 70. A grease fitting 90 mounted in an opening contained in the support housing 60 affords means for introducing lubricating grease into the space between the inner member 70 and the housing 60.

Figure 7:
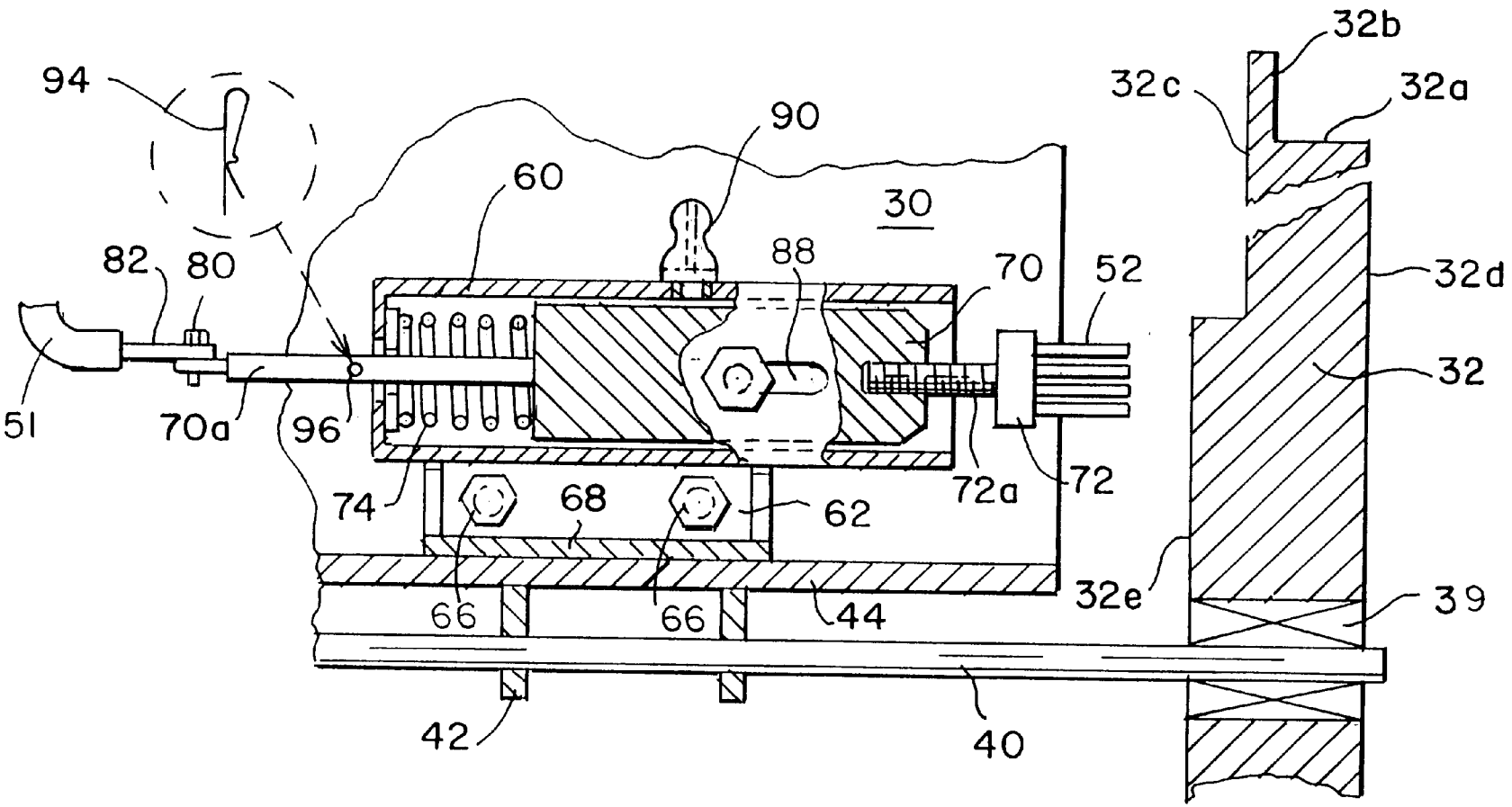
FIG. 7 is a longitudinal sectional view corresponding to FIG. 5 with the brush supporting in the retracted inoperable condition.

It is important to note that in accordance with an important feature of the invention, the contact brushes 52 are biased by the compression springs 74 into continuous electrical contact with the adjacent end face 32*c* of the rail wheel 32, thereby compensating for wear of the brushes during use. In order to replace or repair a brush 52, the inner member 70 is displaced against the biasing force of the compression spring toward a retracted position relative to housing 60, as shown in FIG. 7. The inner member may be retained in this retracted position by inserting the legs of a cotter pin 94 into a transverse bore 96 contained in the projecting portion 70*a* of the inner member 70.

Figure 8:
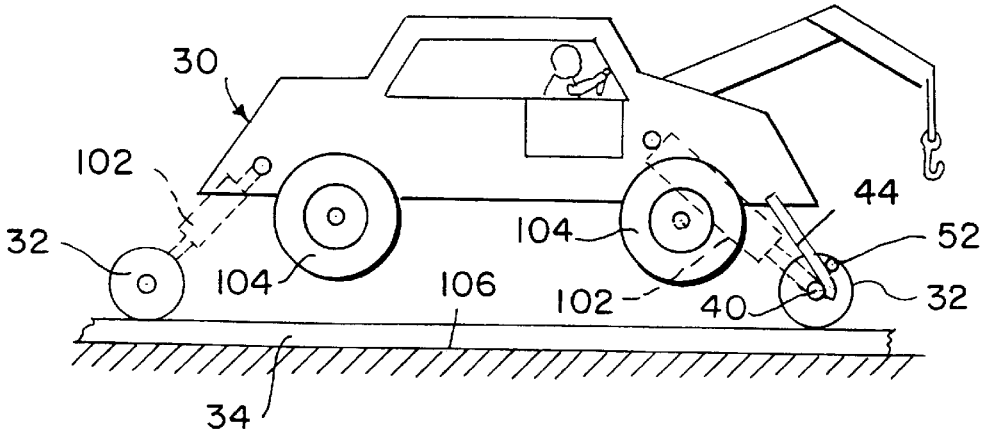
FIG. 8 is a diagrammatic representation of the shunt means of the present invention applied to a Pettibone vehicle.

The shunting system of the present invention may be used with a railway vehicle having only rail wheels that ride on the tracks, or with convertible vehicles having alternately operable pneumatic wheels and rail wheels for transporting the vehicle on the ground or on the tracks, respectively. Examples of the former application are bridge inspection vehicles, bridge crane equipment using railway tie handlers and inserters, maintenance trucks and track geometry trucks. Examples of the convertible type railway vehicles are those shown in the aforementioned Powell U.S. Pat. No. 4,488,494, and the Model 441-C convertible railway vehicle produced by Petibone Corporation of Chicago, Ill., illustrated diagrammatically in FIG. 8. As shown in FIGS. 6 and 8, the rail wheel axle 40 is supported by the axle cover 44 that is pivotally connected by pivot 100 with the vehicle chassis. Hydraulic motor means 102 are connected with the vehicle chassis for lowering the rail wheels from their elevated position to the illustrated lowered position on the tracks 34, thereby to raise the vehicle and its resilient wheels 104 upwardly from the ground 106. Normally, when the vehicle is in the elevated position of FIG. 8, the vehicle is driven by the engagement between the resilient wheels 104 and auxiliary driven cylindrical extensions 108 on the rail wheels, as shown in phantom in FIG. 4.

Instead of welding the brush support housing to the axle guard, it is appropriate that the shunting means could be connected by straps either to the axle cover members, or to other suitable parts of the vehicle. Furthermore, as shown in phantom in FIG. 4, the contact means 154 could be supported by the vehicle chassis for engagement with adjacent end faces of the rail wheels at locations spaced radially outwardly from the rail wheel hub portions.

Figure 9:
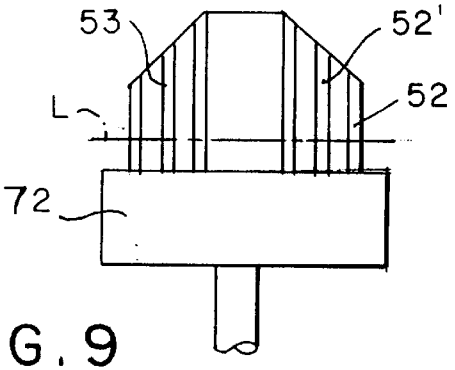
FIG. 9 is a detailed sectional view of a knotted wire brush contact.

Referring to FIG. 9, it will be seen that in cross section, the annular area defined by the twisted wire ropes 52 may initially be tapered to define a generally frusto conical end surface 53, thereby to effect an improved initial contact with the associated end surface of the wheel. During extended use, the twisted wire rope brush is worn down to the level L, whereupon the brush is replaced as described above.

While in accordance with the provisions of the Patent Statutes the preferred forms and embodiments of the invention have been illustrated and described, it will be apparent to those skilled in the art that various changes may be made in the apparatus without deviating from the inventive concepts set forth above.

What is claimed is:

1. A railway vehicle adapted for transport upon a pair of parallel rails connected with a position monitoring and dispatching control system, comprising:

(a) a vehicle chassis;

(b) a pair of rail wheels at least partially supporting said chassis for transport along said rails, said rail wheels having adjacent end surfaces, each of said rail wheels being rotatable about an axle connected with said chassis;

(c) a pair of brush support means connected with said chassis between said rail wheels and adjacent the adjacent end surfaces thereof, respectively, each of said brush support means including:

(1) an hollow outer housing having a longitudinal axis parallel with the axis of rotation of the associated wheel, said outer housing having an open first end adjacent the associated rail wheel; and (2) an inner support member mounted for longitudinal displacement within said outer housing first end, said inner support member having a first end adjacent the associated rail wheel;

(d) a pair of electrically conductive brush means carried by said inner support member first ends, respectively, each of said brush means extending longitudinally toward the associated rail wheel and having an end extremity arranged for engagement with the adjacent end surface of the associated wheel;

(e) spring means biasing said inner support members axially outwardly apart in first directions relative to their respective outer housings toward extended positions in which the extremities of said brush means are in electrical engagement with the adjacent end surfaces of the associated rail wheels, respectively; and (f) shunt conductor means electrically connecting said brush means, thereby to establish a shunt across the rails engaged by the respective rail wheels.

2. A railway vehicle as defined in claim 1, and further including:

(g) a plurality of resilient wheels operable to engage the ground for transport of the vehicle;

(h) means connecting the axle of each of said rail wheels for vertical displacement relative to said chassis between an elevated position in which the rail wheels are spaced above the rails and the resilient wheels are in engagement with the ground, and a lowered position in which the rail wheels are in engagement with the rails and the resilient wheels are spaced above the ground; and (i) motor means for displacing the axle of each rail wheel between its elevated and lowered positions, respectively.

3. A railway vehicle as defined in claim 2, wherein said rail wheels include annular inner hub portions; and wherein said pair of rails wheels are rotatable about a common axle; and further wherein said means connecting said axle for vertical displacement includes:

(j) an axle cover connected with said axle for movement relative to said vehicle chassis, said brush support means being mounted on said axle cover opposite the hub portions of the associated rail wheels, respectively.

4. A railway vehicle as defined in claim 1, wherein each of said brush means is removably connected with the associated inner support member, said inner support members being inwardly displaceable together toward retracted positions relative to their respective outer housings, thereby to permit replacement of a worn brush member.

5. A railway vehicle as defined in claim 4, and further including:

(g) retaining means for retaining said inner support members in their retracted positions relative to said support housings, respectively.

6. A railway vehicle as defined in claim 4, wherein each of said brush means comprises a brush including a plurality of twisted wire ropes extending longitudinally toward the associated rail wheel.

7. A railway vehicle as defined in claim 1, wherein each of said outer housings has a second end that is closed by an end wall; and further wherein each of said inner support members is formed of a conductive metal and includes at a second end thereof a longitudinal extension that extends through an opening contained in said outer housing end wall, said shunt conductor means being connected with said brush means via the associated longitudinal extensions and the associated inner support members, respectively.

8. A railway vehicle as defined in claim 7, wherein said spring means comprises a pair of compression springs mounted within said outer housing second ends between said inner support members and said housing end walls, respectively.

9. A railway vehicle as defined in claim 8, wherein said rail wheels include annular inner hub portions; and wherein each of said outer housings is tubular; wherein each of said inner support members is cylindrical and concentrically arranged within said outer housing members, respectively; and further including:

(g) support means for connecting each of said outer housings with the vehicle chassis opposite the hub portions of the associated rail wheels, respectively.

10. A railway vehicle as defined in claim 9, and further including:

(h) grease fitting means for supplying a lubricant between each of said inner support members and its associated outer housing.

11. A railway vehicle system as defined in claim 1, wherein said rail wheels include hub portions; and further wherein said brush support means support said brushes for engagement with the adjacent end surfaces of said rail wheels at locations spaced radially outwardly from said rail wheel hub portions.

* * * * *